US012742624B2

(12) United States Patent
Pomerleau

(10) Patent No.: US 12,742,624 B2
(45) Date of Patent: Sep. 22, 2026

(54) PROJECTILE SYSTEM

(71) Applicant: Daniel Guy Pomerleau, Calgary (CA)

(72) Inventor: Daniel Guy Pomerleau, Calgary (CA)

( * ) Notice: Subject to any disclaimer, the term of this patent is extended or adjusted under 35 U.S.C. 154(b) by 0 days.

(21) Appl. No.: 19/049,865

(22) Filed: Feb. 10, 2025

(65) Prior Publication Data

US 2025/0257986 A1 Aug. 14, 2025

Related U.S. Application Data

(60) Provisional application No. 63/552,010, filed on Feb. 9, 2024.

(51) Int. Cl.

| | |
|---|---|
| ***F42B 14/06*** | (2006.01) |
| ***F42B 5/24*** | (2006.01) |
| ***F42B 12/82*** | (2006.01) |
| ***F42B 14/02*** | (2006.01) |

(52) U.S. Cl.

CPC ..... *F42B 14/02* (2013.01); *F42B 5/24* (2013.01); *F42B 12/82* (2013.01)

(58) Field of Classification Search

CPC .. E21B 43/117; E21B 43/116; E21B 43/1185; E21B 43/119; E21B 29/02; F42B 3/08; F42B 1/02; F42B 10/025; F42B 10/08; F42B 10/28; F42B 14/06; F42B 10/26; F42B 12/82; F42B 14/02; F42B 10/66; F42B 5/24

See application file for complete search history.

(56) References Cited

U.S. PATENT DOCUMENTS 3,207,074 A * 9/1965 Kinna ..... F42B 5/307 102/467
3,289,589 A * 12/1966 Hitchens ..... F42B 12/40 102/513
3,577,921 A * 5/1971 Van Langenhoven ..... F41A 19/56 102/431
3,618,246 A * 11/1971 Woodring ..... F42B 5/105 42/76.01
3,745,926 A * 7/1973 Mertz ..... F42B 10/08 102/703
4,467,724 A * 8/1984 Marlow ..... F42B 14/061 102/520
4,622,900 A * 11/1986 Witt ..... F41G 9/02 102/214
4,848,238 A * 7/1989 Bocker ..... F42B 12/18 89/36.17
4,870,905 A * 10/1989 Sippel ..... F42B 14/02 102/524

(Continued)

*Primary Examiner* — Michael D David

(74) *Attorney, Agent, or Firm* — VLP Law Group LLP; Michel E. Bohn; Benjamin J. Carroll

(57) ABSTRACT

A projectile system is described, the projectile system includes a projectile body, the projectile body including a front end portion that tapers to a point at the front end and the front end portion of the projectile body is dimensionally smaller than a bore of a firearm system, the projectile body including a driving band portion behind the front end portion of the projectile body, the driving band the driving band portion being dimensionally equal to a caliber of the firearm system and dimensionally greater than a bore diameter of the firearm system, such that the driving band portion comes into contact with the bore of the firearm system when the projectile passes through the bore of the firearm system.

18 Claims, 11 Drawing Sheets

(56) References Cited

U.S. PATENT DOCUMENTS

| | | | | |
|---|---|---|---|---|
| 4,911,079 | A * | 3/1990 | Sauvestre | F42B 14/061 102/521 |
| 5,127,332 | A * | 7/1992 | Corzine | F42B 12/34 102/517 |
| 6,293,203 | B1 * | 9/2001 | Alexander | F42B 5/025 89/14.05 |
| 6,481,356 | B2 * | 11/2002 | Gualandi | F42B 30/02 102/517 |
| 7,222,573 | B2 * | 5/2007 | Pontieri | F42B 10/24 102/524 |
| 7,827,915 | B1 * | 11/2010 | Hall | F42B 14/06 42/90 |
| 11,668,549 | B2 * | 6/2023 | Peterson | F42B 8/04 42/51 |
| 2006/0027130 | A1 * | 2/2006 | Parker | F42B 14/02 102/524 |
| 2015/0241183 | A1 * | 8/2015 | Padgett | F42B 8/04 102/466 |
| 2023/0384070 | A1 * | 11/2023 | Hall | F42B 14/067 |

* cited by examiner

PROJECTILE SYSTEM

BACKGROUND

The present disclosure relates to a projectile system.

Conventional projectile systems employ a projectile, such as a bullet, which is fitted into a cartridge, such as a brass cartridge that includes a powder load and a primer. The bullet is fired by striking the primer and igniting the powder load, which causes the bullet to be expelled out of the cartridge and down a barrel of a firearm system. In conventional projectile systems, the bullet is dimensionally configured to fit tightly within the bore of the barrel in order to seal in the driving force from the powder load to push out the bullet. Additionally, to improve accuracy, in conventional projectile systems, the barrel includes rifling channels that rotate through the interior of the barrel and as the sides of the bullet make contact with the rifling channels, they impart spin on the bullet as it passes through the bore. However, due to the friction created by the bullet making contact with the interior surface of the barrel, the barrels can heat-up and the sizes of the powder loads have to be carefully matched to the weights of the bullet in order to not create an excessive amount of backpressure that can damage the firearm system or user.

SUMMARY

In some aspects, the techniques described herein relate to a projectile system including: a projectile body, the projectile body including a front end portion that tapers to a point at the front end and the front end portion of the projectile body is dimensionally smaller than a bore of a firearm system, the projectile body including a driving band portion behind the front end portion of the projectile body, the driving band portion being dimensionally equal to a caliber of the firearm system and dimensionally greater than a bore diameter of the firearm system, such that the driving band portion comes into contact with the bore of the firearm system when the projectile passes through the bore of the firearm system, the projectile body including an end portion behind the driving band portion; and a boot configured to wrap around the end portion of the projectile body and provide an additional seal when the projectile passes through the bore of the firearm system.

In some aspects, the techniques described herein relate to a projectile system, wherein the front end portion of the projectile body further includes a plurality of flutes configured to center the projectile body within the bore of the firearm system when the projectile body is positioned into the firearm system.

In some aspects, the techniques described herein relate to a projectile system, wherein the plurality of flutes includes at least four flutes.

In some aspects, the techniques described herein relate to a projectile system, wherein the plurality of flutes includes at least five flutes.

In some aspects, the techniques described herein relate to a projectile system, wherein the plurality of flutes includes six flutes.

In some aspects, the techniques described herein relate to a projectile system, wherein the projectile body includes one or more grooves formed into an exterior surface of the projectile body.

In some aspects, the techniques described herein relate to a projectile system, wherein one or more grooves are configured to retain one or more latex bands, wherein each latex band of the one or more latex bands wrap around the projectile body and are seated within different grooves of the one or more grooves.

In some aspects, the techniques described herein relate to a projectile system, wherein the one or more grooves include a lubricant, such that when the projectile is moving down the bore, the lubricant coats the bore.

In some aspects, the techniques described herein relate to a projectile system, wherein the one or more grooves are positioned on the projectile body ahead of the driving band portion and the lubricant coats the bore ahead of the driving band portion as the projectile is moving down the bore.

In some aspects, the techniques described herein relate to a projectile system, wherein the driving band portion is segmented and one or more grooves are within the driving band portion of the projectile band.

In some aspects, the techniques described herein relate to a projectile system, wherein the boot is configured to disengage from the projectile body as the projectile moves down and exits the bore.

In some aspects, the techniques described herein relate to a projectile system, wherein the boot cleans a surface of the bore as the projectile moves down and exits the bore.

In some aspects, the techniques described herein relate to a projectile system, wherein the wherein the projectile body further includes a plurality of flutes configured to center the projectile body within the bore of the firearm system and wherein a quantity of flutes in the plurality of flutes matches with a rifling pattern within the bore of the firearm system.

In some aspects, the techniques described herein relate to a projectile system, wherein the plurality of flutes are in vectored positions to may impart a rotation that matches the rotation generated by rifling pattern within the bore of the firearm system.

In some aspects, the techniques described herein relate to a projectile system, wherein the plurality of flutes impart aerodynamic spin to the projectile body when the projectile body is fired from the bore.

In some aspects, the techniques described herein relate to a projectile system, wherein driving band portion of the projectile body is dimensionally wider than the other portions of the projectile body and the driving band portion is configured to make frictional contact with an interior of the bore when fired.

In some aspects, the techniques described herein relate to a projectile system, wherein the driving band portion has a reduced bearing surface when only the driving band portion engages with the bore.

In some aspects, the techniques described herein relate to a projectile system, wherein the driving band portion is able to maintain a high engraving efficiency.

In some aspects, the techniques described herein relate to a projectile system including: a projectile body, the projectile body being cylindrically shaped and including a front end portion that tapers to a point at the front end and the front end portion of the projectile body is dimensionally smaller than a cylindrical bore of a firearm system, the projectile body further including a driving band portion behind the front end portion of the projectile body, the driving band portion being dimensionally equal to a caliber of the firearm system and dimensionally greater than a bore diameter of the firearm system, such that the driving band portion comes into contact with the cylindrical bore of the firearm system when the projectile passes through the bore of the firearm system, the projectile body including an end portion behind the driving band portion; and a plurality of flutes positioned on an exterior surface of the projectile body ahead of the driving band portion of the projectile body, the plurality of flutes being configured to center the projectile body within the bore of the firearm system when the projectile body is positioned into the firearm system.

In some aspects, the techniques described herein relate to a projectile system, further including: a boot configured to wrap around the end portion of the projectile body and provide an additional seal when the projectile passes through the bore of the firearm system.

The above and other implementations are advantageous in a number of respects as articulated through this document. Moreover, it should be understood that the language used in the present disclosure has been principally selected for readability and instructional purposes, and not to limit the scope of the subject matter disclosed herein.

BRIEF DESCRIPTION OF THE DRAWINGS

The disclosure is illustrated by way of example, and not by way of limitation in the figures of the accompanying drawings in which like reference numerals are used to refer to similar elements.

DETAILED DESCRIPTION

Figure 1:
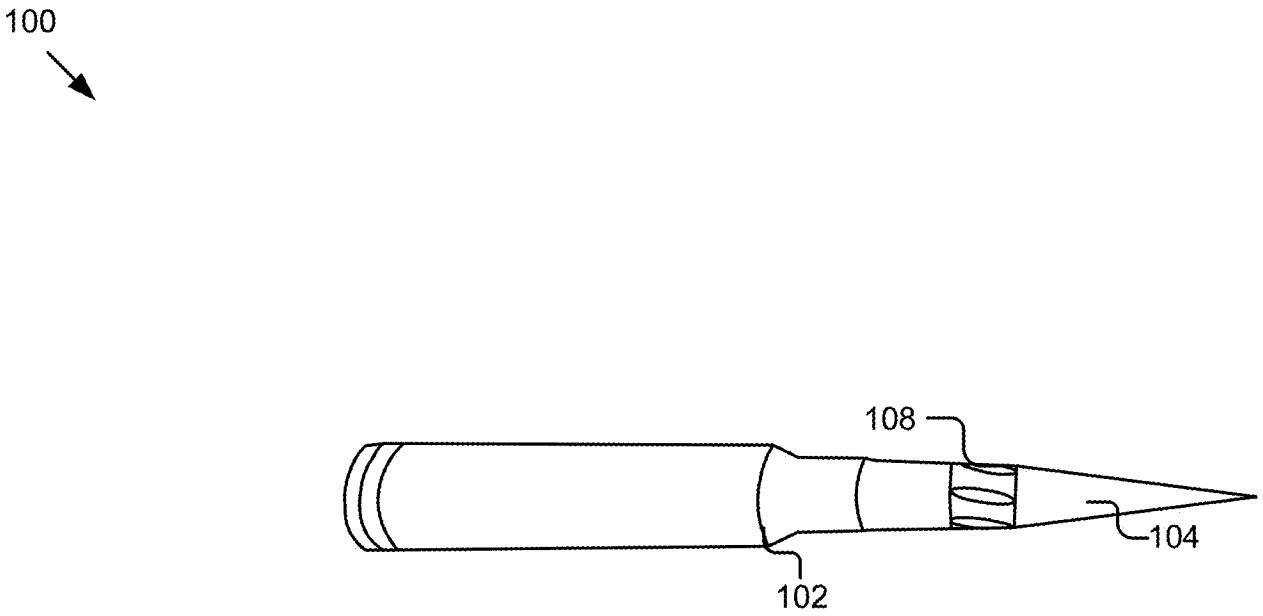
FIG. 1 illustrates an example configuration of a projectile system.

FIG. 1 illustrates an example configuration of a projectile system 100. As shown, projectile system 100 includes a projectile 104 that is configured to be positioned within a conventional cartridge 102 as shown. A projectile, such as a bullet as shown by projectile 104, is essentially a pressure release valve. The greater its resistance to displacement in the barrel of a firearm, the higher the pressure levels. This is why lighter bullets allow for greater powder loads as they evacuate the barrel (pressure vessel) more rapidly than heavier bullets. The bullet shown in FIG. 1, allows for heavier designs to be employed that offer less frictional resistance to movement and thus a more efficient pressure release mechanism.

As shown in FIG. 1, the projectile 104 is seated within the cartridge 102 ahead of a propulsion system contained within the cartridge 102 which causes the projectile 104 to move out of the positioning within the cartridge 102 and down a bore of a barrel when the projectile 104 is fired out of a firearm system (not shown). Conventional center-fire cartridges 102 are loaded with a primer on a back end that causes an ignition of a measure of propulsive powder, such as gun powder, which is contained within the cartridge behind the positioned projectile 104. As shown in FIG. 1, only a front portion of the projectile 104 is exposed and the rest of the projectile 104 is seated within the cartridge 102. The projectile 104 shown in the projectile system 100 is a new projectile that improves on the previous iterations of projectiles used with conventional cartridges 102 by having a smaller bearing surface, e.g., the dimensions of the projectile 104 are narrower than the bore of the barrel in most places, as compared to conventional projectiles. As shown in FIG. 1, the projectile 104 can include front stabilizing flutes 108, such as a plurality of flutes (e.g., one flute, two flutes, three flutes, four flutes, five flutes, six flutes, etc.) that allow for a reduced bearing surface on the projectile 104 in the bore of a firearm system, while the projectile 104 at the same time can still engage with the rifling in the barrel. This decreased bearing surface, compared to conventional projectiles, results in increases in muzzle velocity and muzzle energy for the projectile. In some implementations, when a conventional projectile passes through a rifled barrel, it makes contact with the rifling, which is often referred to as scrolling or engraving. This contact with the rifling imparts a rotation on the conventional projectile. Similarly, the projectile 104, while having a reduced bearing surface, is still able to maintain a high engraving efficiency, (e.g., the measurement of contact between the projectile and the rifling of the bore), while at the same time, reducing the bearing surface area, which reduces the friction impact between the projectile and the bore as described elsewhere herein.

Figure 2:
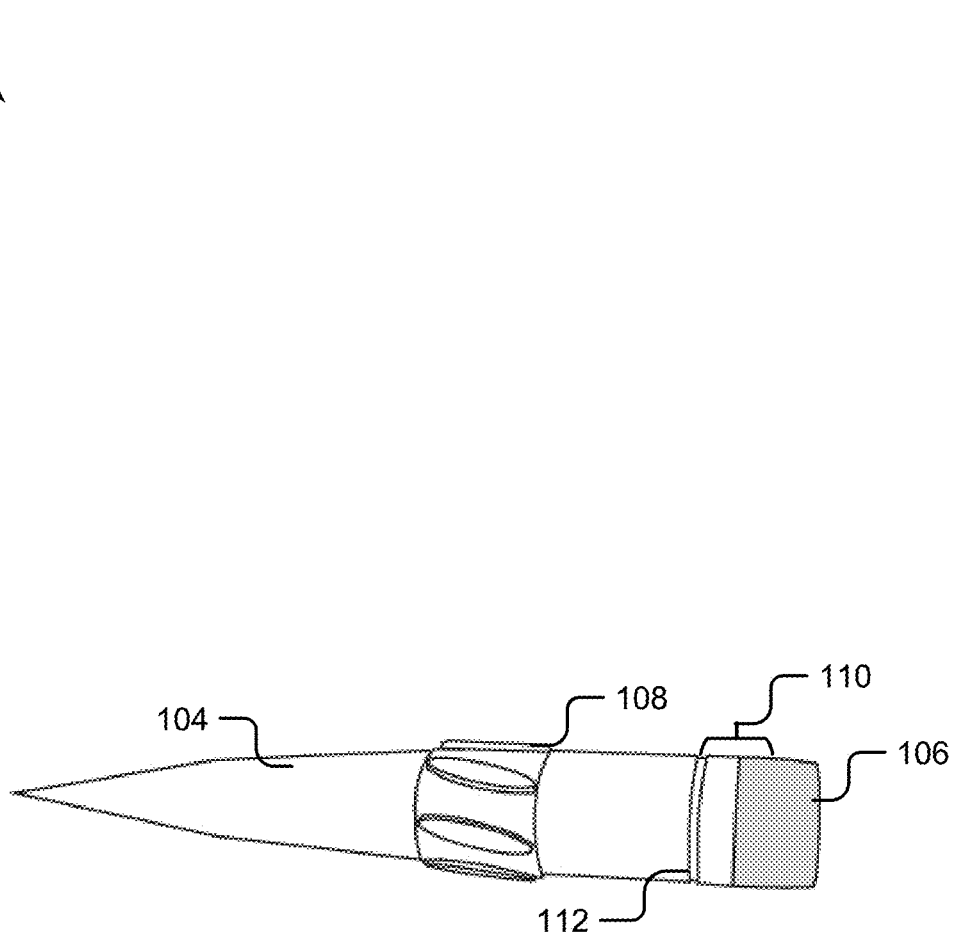
FIG. 2 illustrates a back end of the projectile.

FIG. 2 illustrates a back end of the projectile 104 shown in FIG. 1. As shown in FIG. 2, a back-end of the projectile 104 includes a boot 106 that is configured to be positioned on the back end of the projectile 104 to help seat the projectile 104 within the cartridge 102 and provides support to the driving band 110 seal. The driving band 110 is the portion of the projectile 104 that comes in contact with the interior surface of the barrel, e.g., the bore, and in a bore with rifling, the driving band 110 can engage with the rifling to impact a spin on the projectile 104. In some implementations, the driving band 110 is dimensionally equal to the bore of the firearm system, or in further implementations, the driving band 110 is dimensionally greater than the bore diameter in order for engraving to occur (e.g., engraving is where the driving band 110 makes contact with the rifling, which is also sometimes referred to as scrolling). This means that the diameter or dimensions of the cross section of the driving band portion 110 has to be at least dimensionally equal to the caliber of the firearm system or at least greater than the bore diameter in order for it to make contact with the rifling. The rifling diameter is equivalent to the caliber, while the bore is smaller than the caliber. Typically, the bore diameter is 0.005-0.008 inches narrower than the caliber. The remaining portions of the projectile 104 may be dimensionally smaller in diameter than the driving band portion in order to reduce friction as the projectile 104 moves through the barrel and allowing those smaller diameter portions to not make contact with the interior of the barrel. The projectile 104 uses the driving band 110 to make contact and/or achieve spin from the rifling on the inside of a barrel of a firearm system. In some implementations, to achieve this contact, the driving band 110 may be slightly larger than the pure bore of the barrel and as wide as the rifling grooves of the barrel as it may also need to fit tightly into a cartridge 102 that is configured to hold a projectile that is the diameter of the rifling, which in conventional systems is greater than the pure bore of the barrel. In some implementations, the thicker the driving band 110, the greater the frictional interaction between the driving band 110 and the barrel, which results in decreased muzzle velocity. At the same time, the driving band 110, also needs to create an effective seating within the barrel (e.g., a seal between the driving band 110 and the interior of the barrel) in order to maximize the propelled energy (e.g., the driving force) from the cartridge that is pushing the projectile out of the barrel.

In some implementations, the driving band 110 includes the boot 106 and acts as the end cap which ensures a positive seal in the cartridge 102. The boot 106 can be formed out of a plastic or other suitable material to provide the positive seal with the driving band 110 and the bore of the barrel and as the projectile 104 moves down the barrel, the boot 106 can be configured to dissipate and/or release from the projectile 104 (e.g., disengage) as it wears down due to the friction as the projectile 104 moves down and exits out of the bore of the barrel. In some implementations, the projectile may include a plurality of flutes 108 that extend out of the body of the projectile 104 and are configured to retain the projectile 104 in a centered position inside of the bore of the barrel when the projectile 104 is chambered into the bore. In some implementations, the flutes 108 can be angled to match the rifling of the barrel and may include as many flutes 108 as there are barrel rifling. In some implementations, the vectored positions of the flutes 108 may impart a rotation that matches and/or compliments the rotation generated by the driving band 110 and rifling pattern (e.g., the number and/or twist pattern of the rifling grooves in the bore). In some implementations, the flutes 108 may further impart aerodynamic spin to the projectile 104 as well as it is fired from a firearm system. In some implementations, a small plastic piece (or other suitable material) could be positioned on the projectile 104 in place of the flutes 108 to keep the projectile 104 centralized within the bore when chambered and then once the projectile 104 is fired, the small plastic piece could separate once the projectile 104 transited the barrel. In some implementations, a front edge of the flutes 108 can be tapered in order to transit a feed ramp of a rifle barrel in some firearm system.

In some implementations, as the boot 106 moves down the bore of the barrel as the projectile 104 is fired, the boot 106 also cleans out a significant portion of any fowling in the barrel from the previous rounds. This self-cleaning action using the boot 106 allows the firearm system to operate more efficiently, with increased accuracy for fouling up shots and greater periods of time as compared to conventional projectiles for when shooting has to be halted in order to clean or change out the barrels. In some implementations, different types of plastics or other suitable materials have been used to achieve different results in the self-cleaning action as the boot 106 moves down the barrel.

In some implementations, the projectile may include one or more grooves 112 or segments that can be formed into the exterior surface of the projectile 104. As shown in FIG. 2, the grooves 112 can be positioned ahead of the driving band 110. In some implementations, the grooves 112 can retain one or more latex bands that can wrap around the projectile 104 and be seated within the groove 112. In some implementations, the latex bands can provide additional sealing between the projectile 104 and the cartridge 102 or additional seating in the bore when the projectile 104 is initially fired. In further implementations, one or more of the grooves 112 can include a lubricant, such as a ring made from latex or other suitable materials, that can coat the bore ahead of the driving band 110 in order to lubricate the bore ahead of the portion of the projectile 104 that engages with the bore, such as the driving band 110 and/or the boot 106.

Figure 3A:
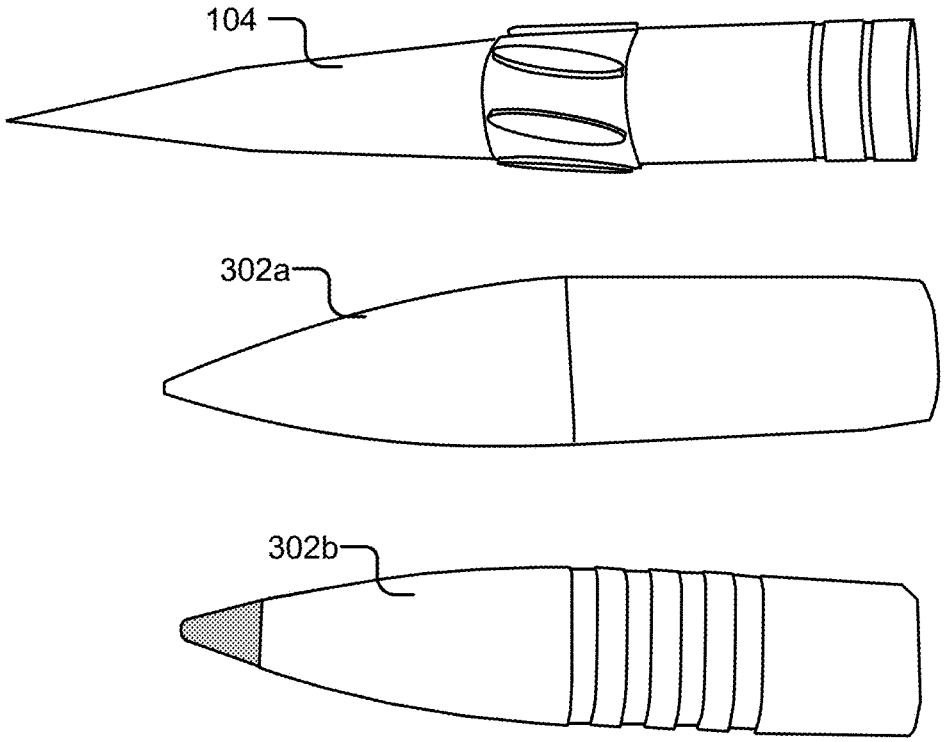
FIG. 3A illustrates example conventional projectiles compared with the new projectile.

FIG. 3A illustrates example conventional projectiles 302*a* and 302*b* compared with the projectile 104. As shown in the image in FIG. 3A, the projectile 104 and the conventional projectiles 302 are both chambered in the .338 caliber of rounds. As shown in FIG. 3A, the projectile 104 is longer in length as compared to each of the conventional 302, while also having a narrowing front end as compared to the conventional projectiles 302. Additionally, other than the flutes that extend out as shown in FIG. 2, the dimension of the majority of the projectile 104 is narrower than the dimensions of a bore of a .338 rifle barrel.

Figure 3B:
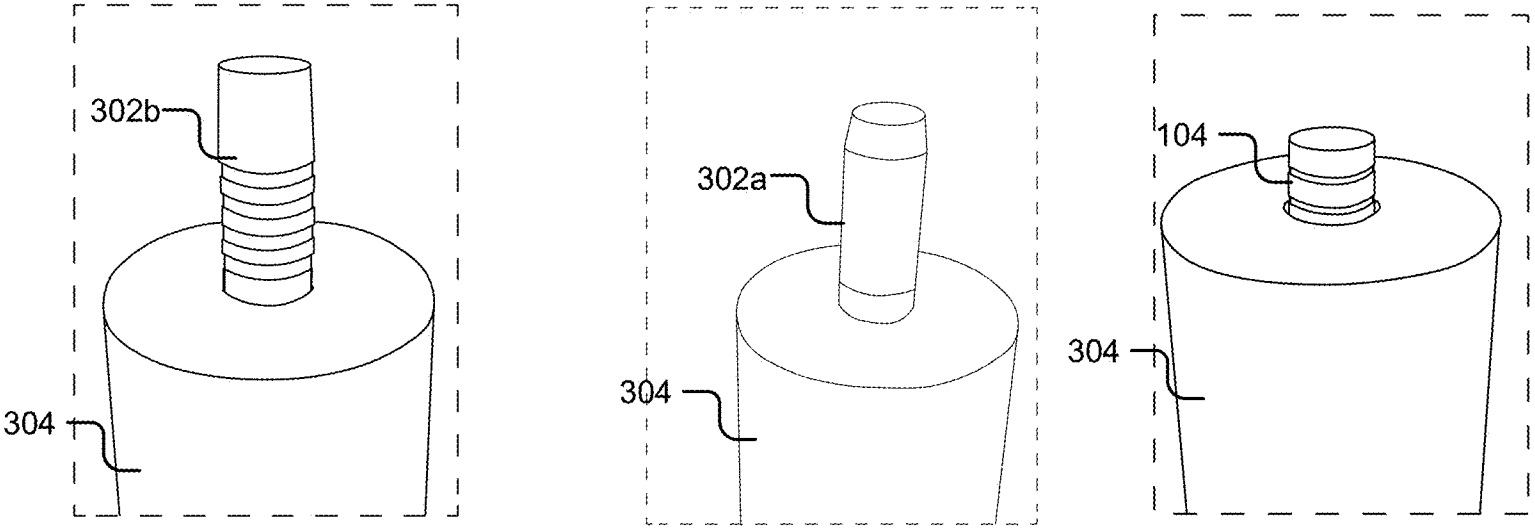
FIG. 3B illustrates example conventional projectiles compared with the new projectile in a rifle barrel.

As shown in FIG. 3B, a rifle barrel 304 chambered in .338 caliber is shown with each of the projectiles 104 and conventional projectiles 302 being placed within the bore of the rifle to demonstrate the fit and illustrate the friction difference as the projectile 104 moves down the bore. As shown in FIG. 3B, the conventional projectile 302*b* only fits a small portion of the front end of the conventional projectile 302*b*, which results in an increased friction as the conventional projectile 302*b* moves down the bore when fired. Additionally, as shown in FIG. 3B, the conventional projectile 302*a*, also only fits a small portion of the front end of the conventional projectile 302*a*, which results in an increased friction as the conventional projectile 302*a* moves down the bore when fired. However, as shown in FIG. 3B, the projectile 104, because of the narrower dimensions on the front end and the only slightly larger dimensions on the driving band 110 as shown with respect to FIG. 2, the majority of the projectile 104 fits within the bore of the barrel 304 without making contact with the bore. This results in a lower friction effect as the projectile moves through the bore, which allows for potentially higher powder loads and increased velocity due to the decreased friction as compared to conventional projectiles 302. Alternatively, at lower powder loads, a similar muzzle velocity could be achieved by a projectile 104 as compared to the same muzzle velocity of a conventional projectile.

In some implementations, the projectile 104 performs differently as compared to conventional bullets in cartridges. Typically, the heavier a projectile that is propelled through a barrel is, the less powder load is used in the cartridge to propel it. This essentially means that lighter projectiles (e.g., bullets) get more powder load behind them and the performance results is that lighter projectiles are faster as compared to heavier projectiles. Furthermore, if a lighter bullet powder load is combined with a heavier bullet, an unsafe condition is created. One of the results of this unsafe condition is that it creates over pressure conditions where the projectile is chambered. This back pressure results because of the greater resistance of the heavier bullet moving down the barrel and the resulting back pressure on the cartridge and the primer can cause damage to the brass and primer. These over pressure conditions are well understood by cartridge loaders and are avoided by carefully measuring the powder load combinations with various projectile weights and ensuring that a powder load is not too high for a bullet weight. However, the projectile 104 shown in FIGS. 1 and 2 has been successfully tested with powder loads well in excess of those recommended for a projectile 104 of that weight. For example, in the .338 caliber, the powder loads were tested at the maximum load's recommended for the lightest bullets available for the .338 caliber. Because of the way the projectile system 100 is designed, with the use of the boot 106, the limited amount of projectile 104 surface that comes into contact with the bore, and other design implementations, the powder load for the projectile 104 can be well in excess of what was recommended for conventional projectiles of that weight. This increased powder load allows for an increase in velocity of the projectile 104 when fired that has been tested with a near linear relationship between velocity and powder load.

In conventional firearm systems, after a few bullets have been fired through a firearm barrel, the barrel becomes warm/hot due to the friction between the bore of the barrel and the bullets as they are fired. This effect of heating the barrel can become significant and affect accuracy and/or other performance on the firearm system. Some firearm systems have attempted to address this problem by using special barrel liners, thicker barrel walls, and/or regularly switching out barrels. However, by using a firearm system 100 that employs the projectile 104 with it's decreased friction down the bore of the barrel, there was minimal detected heat build-up during firing. This reduced friction from the projectile 104 can provide a significant improvement to accuracy and/or barrel life by reducing heat buildup in the bore. This can allow for better performance of a firearm system and extended life of the system. For example, if this bullet system 100 were employed in a machine gun that relies on barrels being switched out as it is operated, this bullet system 100 would allow for a significantly larger number of rounds to be fired down the barrel before any heat build up issues would need to be addressed.

As shown in FIG. 2, the boot 106 may be formed out of a plastic material and connected to wrap over a portion of a back end of the projectile 104. The boot 106 provides for an increased seal at the driving band 110. This increased seal is caused by the boot 106 spreading out when the propellant behind the projectile 104 is ignited and allows the boot 106 to spread into any remaining space behind the projectile 104 as the projectile 104 moves down the bore of the barrel. In testing, higher speeds were measured in projectiles 104 that included the boot 106 compared to projectiles 104 fired without a boot 106.

One result of using a projectile 104 with a lower friction in the bore of the barrel is a decrease in recoil (e.g. kick) of a firearm system that fires the projectile 104. This decrease in recoil not only makes operation of the firearm system simpler for a use and can provide for faster and/or more accurate follow-up shots, the decreased recoil also reduces wear on the mechanical operation components of the firearm system. For example, in a conventional firearm system using conventional projectiles, the increased recoil causes an increased movement at a higher force of various components of the firearm system. Over time, this recoil and/or movement of the components of the firearm system, causes the components to wear down and/or break. By reducing that recoil and/or movement of the firearm system, the components have reduced wear and a longer lifespan as compared to when conventional projectiles are used.

Figure 4:
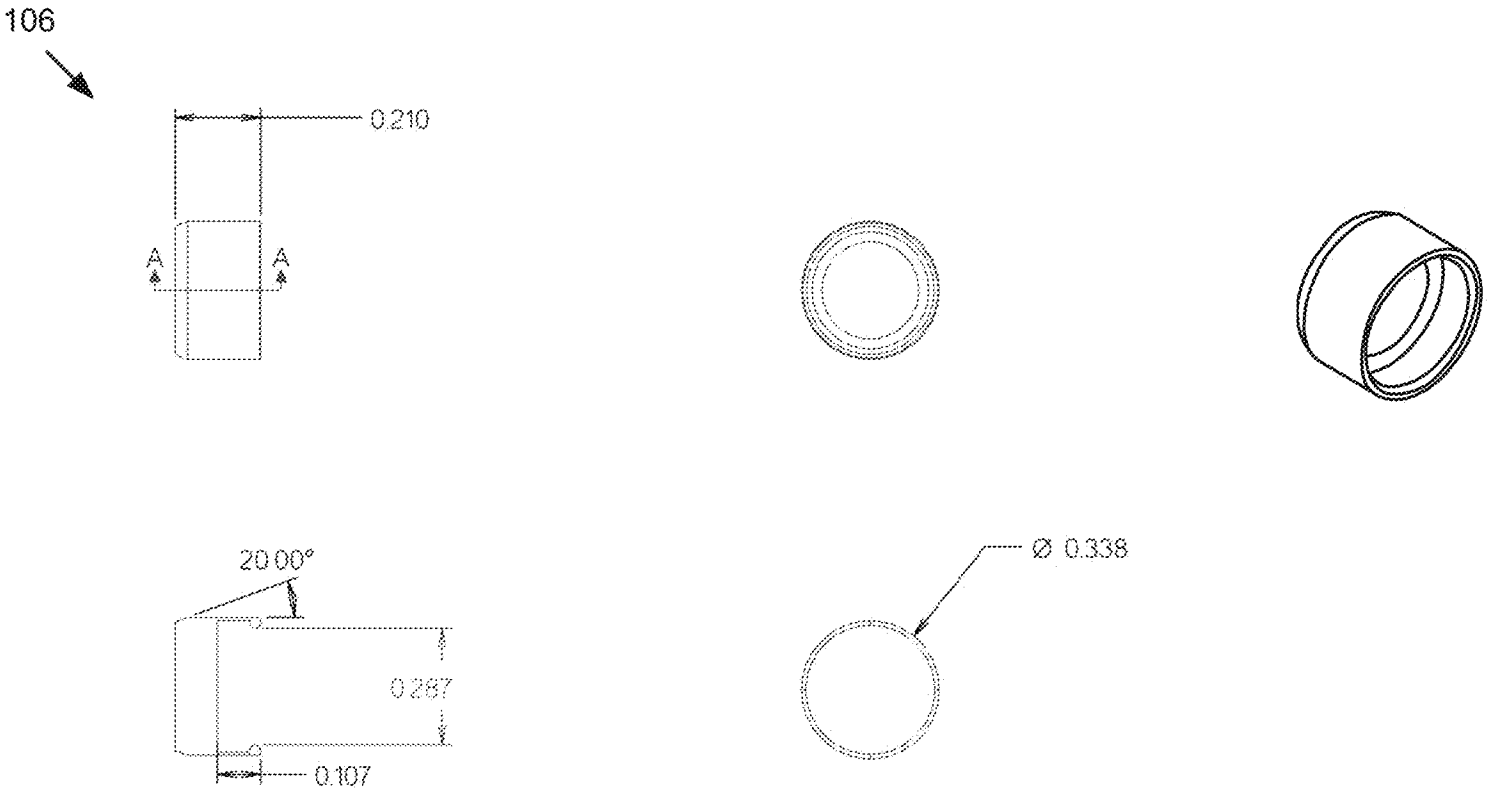
FIG. 4 is an example of a boot or end cap designed for a specific implementation of the projectile system.
Figure 5:
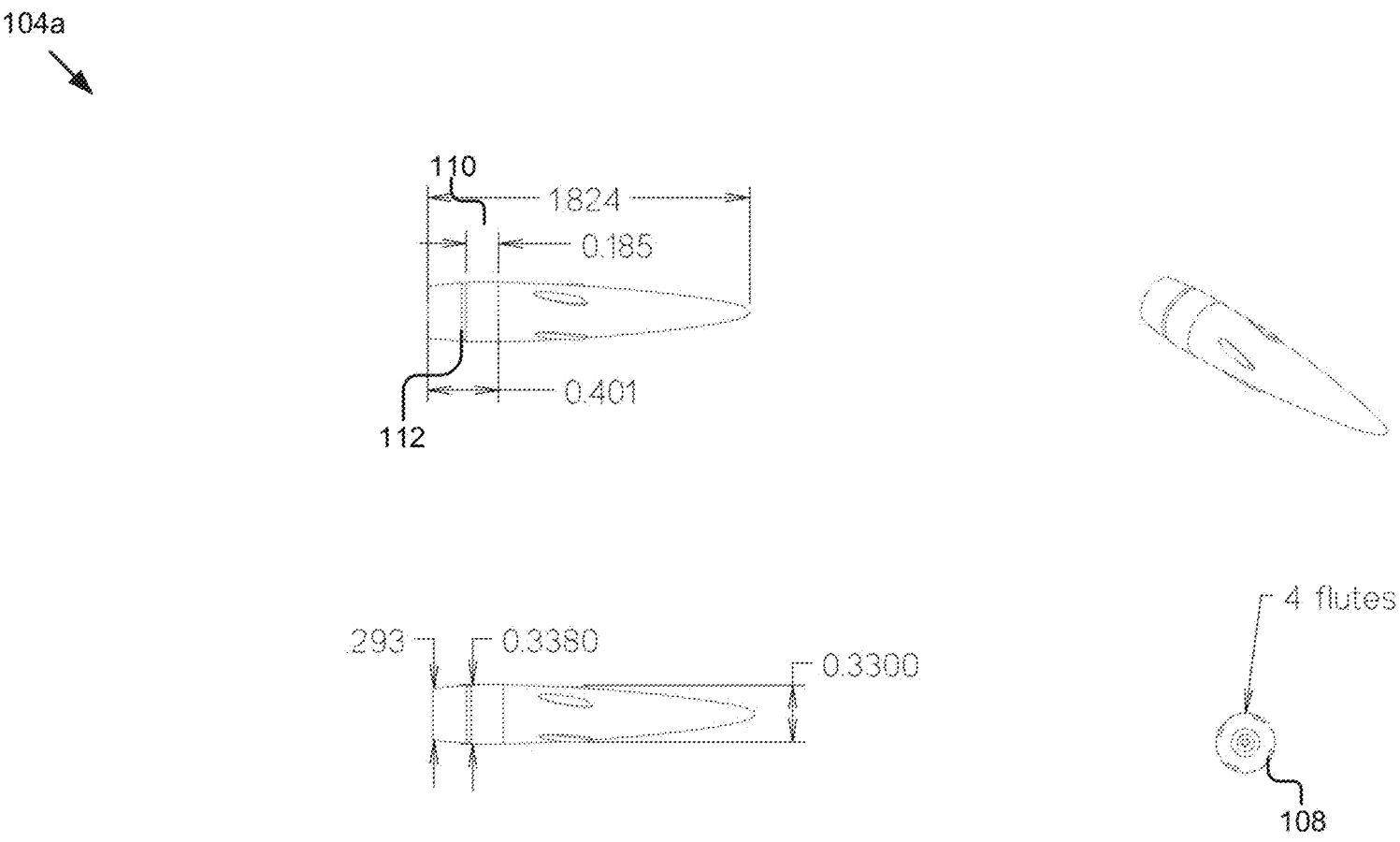
FIG. 5 is an example projectile.

FIG. 4 is an example of a boot 106 designed for a specific implementation of the projectile system 100. As shown in FIG. 4, the boot 106 may be configured to be cylindrically shaped with sides that wrap around a back end of a projectile 104 as shown in FIG. 2. The boot 106 may include a substantially flat back end and the walls that wrap around the projectile 104 extend out cylindrically around an outside edge of a front surface of the flat end of the boot 106. As shown, for a .338 caliber projectile 104 can use the dimensions shown for the boot 106, while other dimensions and projectile calibers are also contemplated. These dimensions are shown merely by way of example for a specific caliber of projectile. Additionally, in some implementations, using the plastic boot 106 can make reloading easier FIG. 5 is an example projectile 104*a*. As shown, this specific example projectile includes a driving band 110 dimension as shown with a single groove 112. As shown in this example, four flutes 108 are shown on the projectile 104*a*. This example is configured to be used in a specific caliber with a barrel that has four rifling. It should be understood that a projectile 104 with any number of flutes 108 can be designed to engage with a barrel with any number of rifling grooves as shown with respect to FIGS. 6-9, as well as other embodiments of flute configurations that are not shown in specific embodiments in the figures, but are contemplated. As shown, the driving band 110 is the widest portion of the projectile 104 and configured to make frictional contact with the interior of the bare of the barrel when fired. It should be understood that these dimensions are shown merely by way of example for a specific caliber of projectile and other dimensions that are appropriate for other calibers are also contemplated.

Figure 6:
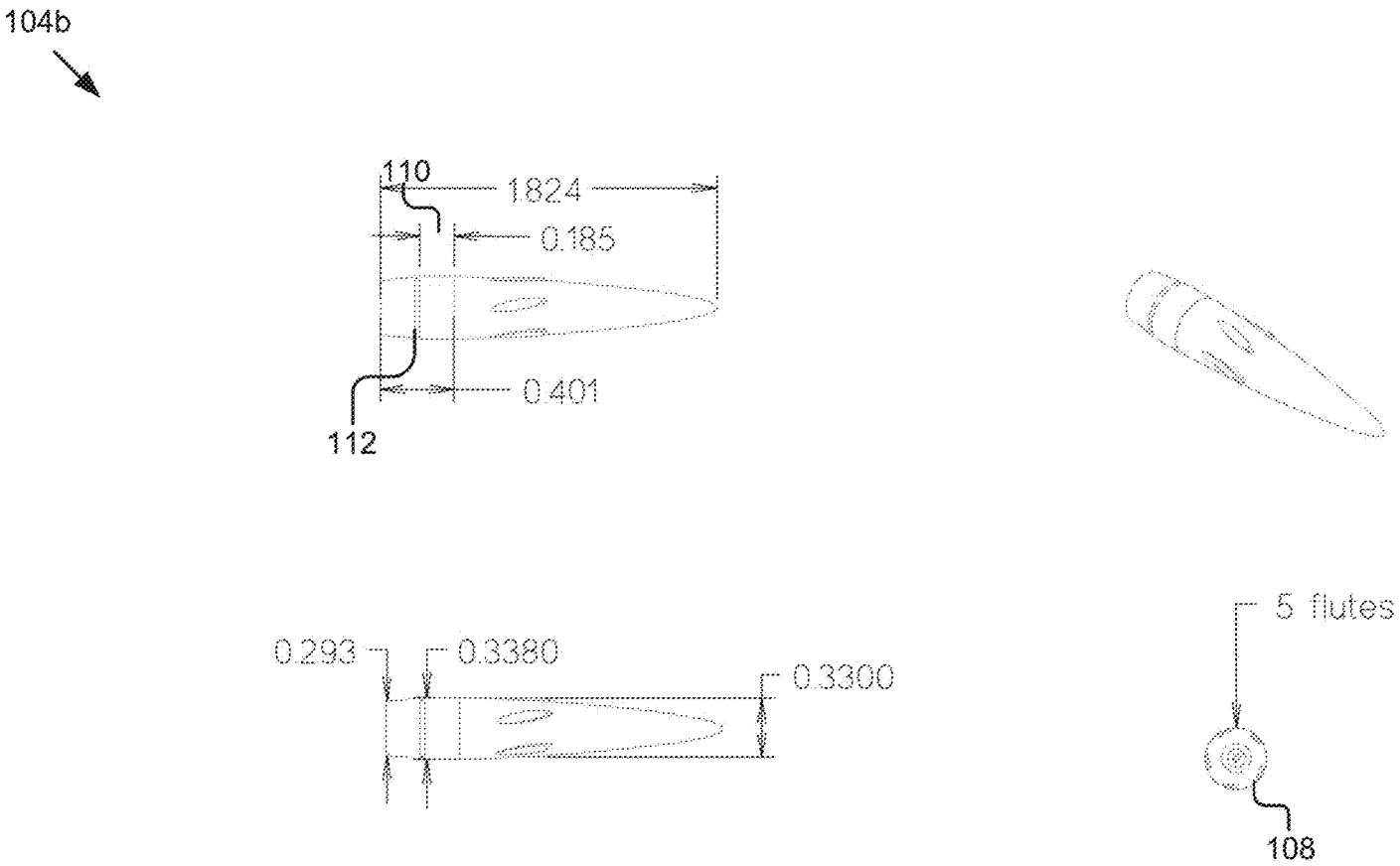
FIG. 6 is another example projectile.

FIG. 6 is an example projectile 104*b*. As shown, this specific example projectile includes a driving band 110 dimension as shown with a single groove 112. As shown in this example, five flutes 108 are shown on the projectile 104*b*. This example is configured to be used in a specific caliber with a barrel that has five rifling or can be used with any other appropriate barrel configuration with a rifling pattern. As shown, the driving band 110 is the widest portion of the projectile 104*b* and configured to make frictional contact with the interior of the bare of the barrel when fired. It should be understood that these dimensions are shown merely by way of example for a specific caliber of projectile and other dimensions that are appropriate for other calibers are also contemplated.

Figure 7:
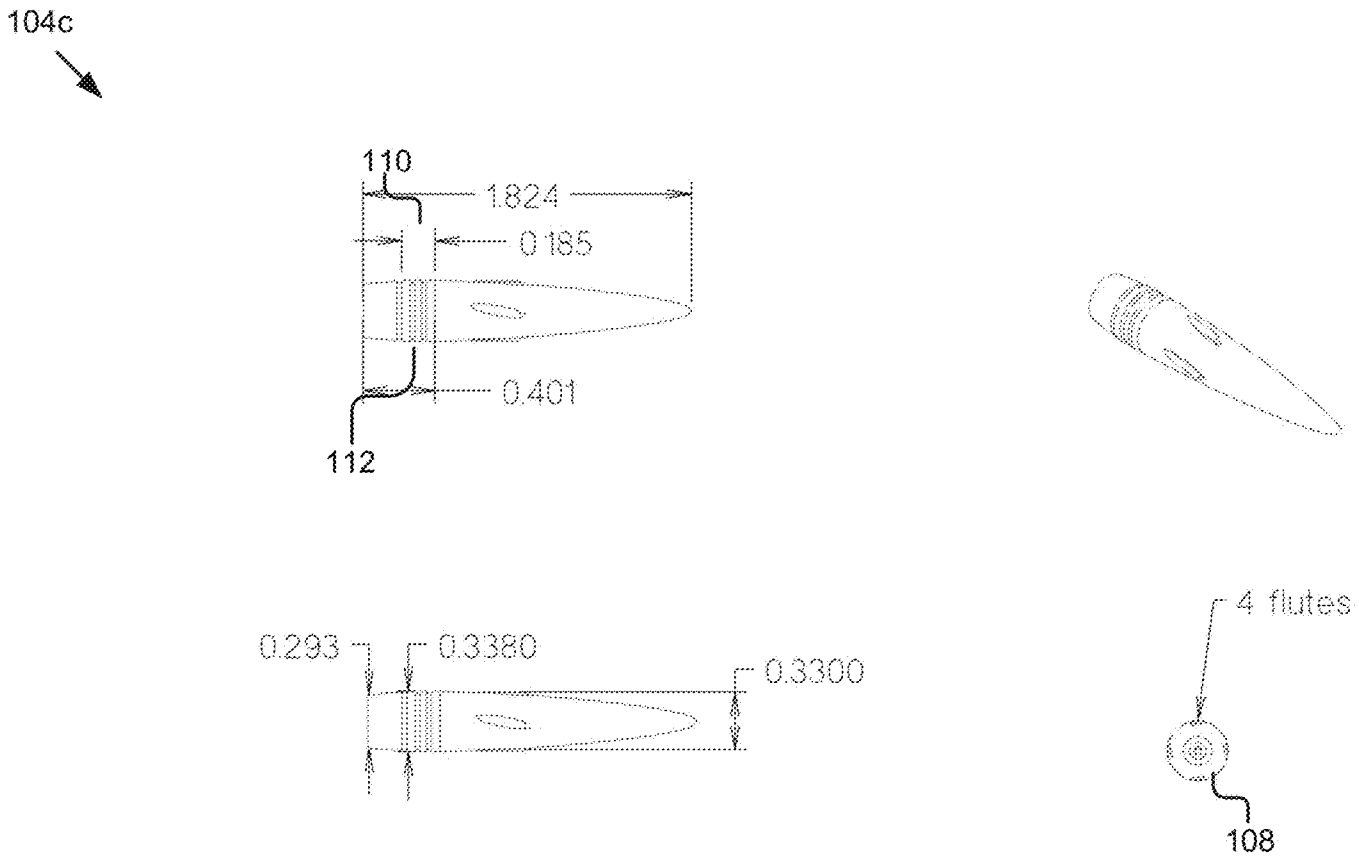
FIG. 7 is another example projectile.

FIG. 7 is an example projectile 104*c*. As shown, this specific example projectile includes a segmented driving band 110 dimension as shown with multiple grooves 112. As described elsewhere herein, one or more of these grooves 112 could receive latex rings that can assist in providing a seal with the bore. As described elsewhere herein, one or more of the grooves 112 could include material to lubricate the bore of the barrel as the projectile 104 passes through the bore. As shown in this example, four flutes 108 are shown on the projectile 104*c*. This example is configured to be used in a specific caliber with a barrel that has four rifling. As shown, the driving band 110 dimension is the widest portion of the projectile 104 and configured to make frictional contact with the interior of the bare of the barrel when fired. It should be understood that these dimensions are shown merely by way of example for a specific caliber of projectile and other dimensions that are appropriate for other calibers are also contemplated.

Figure 8:
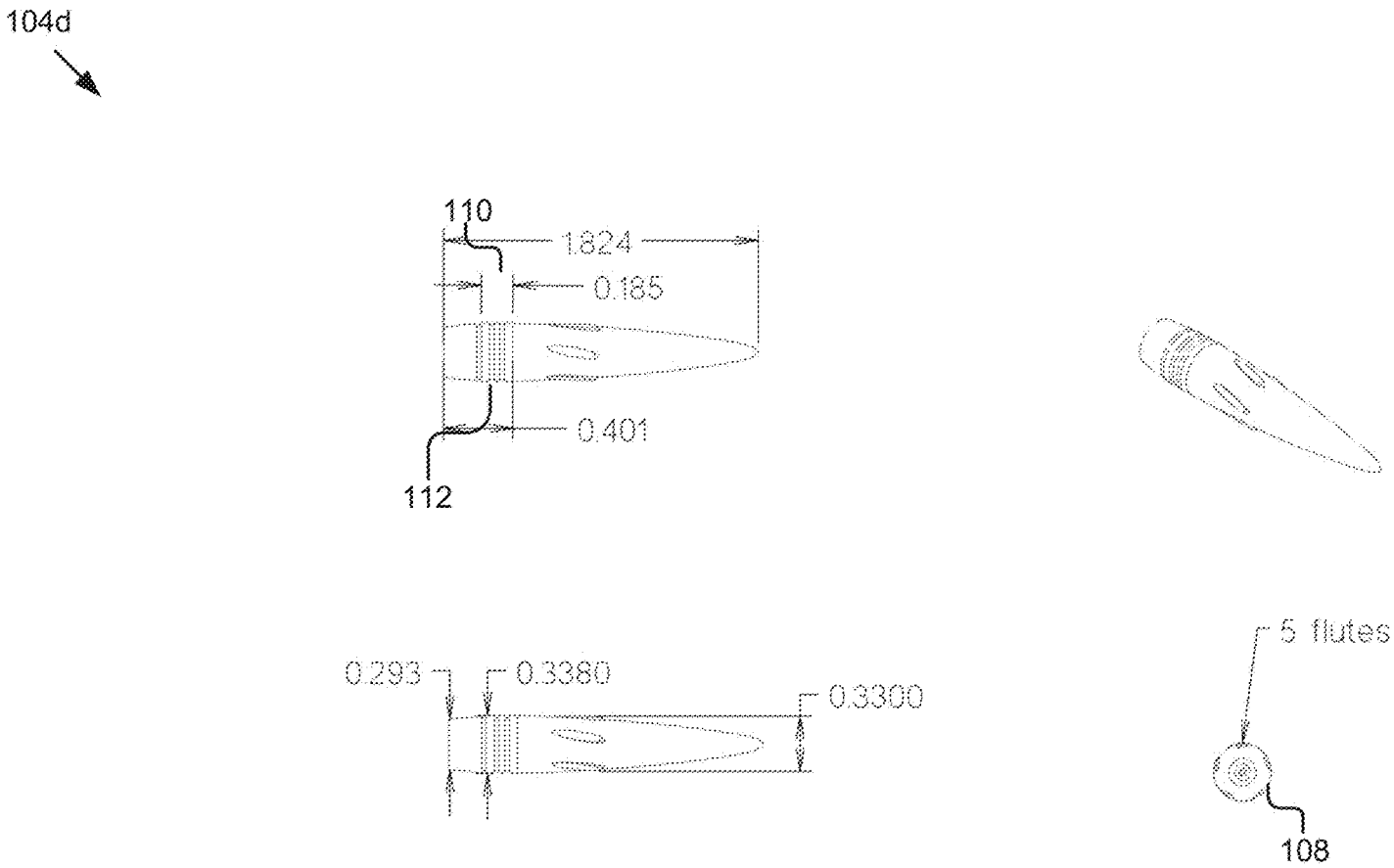
FIG. 8 is another example projectile.

FIG. 8 is an example projectile 104*d*. As shown, this specific example projectile includes a segmented driving band 110 dimension as shown with multiple grooves 112. As described elsewhere herein, one or more of these grooves 112 could receive latex rings or other types of material that fit within the groove 112 that can assist in providing a seal with the bore and/or impart a rotation on the projectile 104*d* as it moves down the bore. As described elsewhere herein, one or more of the grooves 112 could include material to lubricate the bore of the barrel as the projectile 104 passes through the bore. As shown in this example, five flutes 108 are shown on the projectile 104*d*. This example is configured to be used in a specific caliber with a barrel that has five rifling. As shown, the driving band 110 dimension is the widest portion of the projectile 104*d* and configured to make frictional contact with the interior of the bare of the barrel when fired. It should be understood that these dimensions are shown merely by way of example for a specific caliber of projectile and other dimensions that are appropriate for other calibers are also contemplated.

Figure 9:
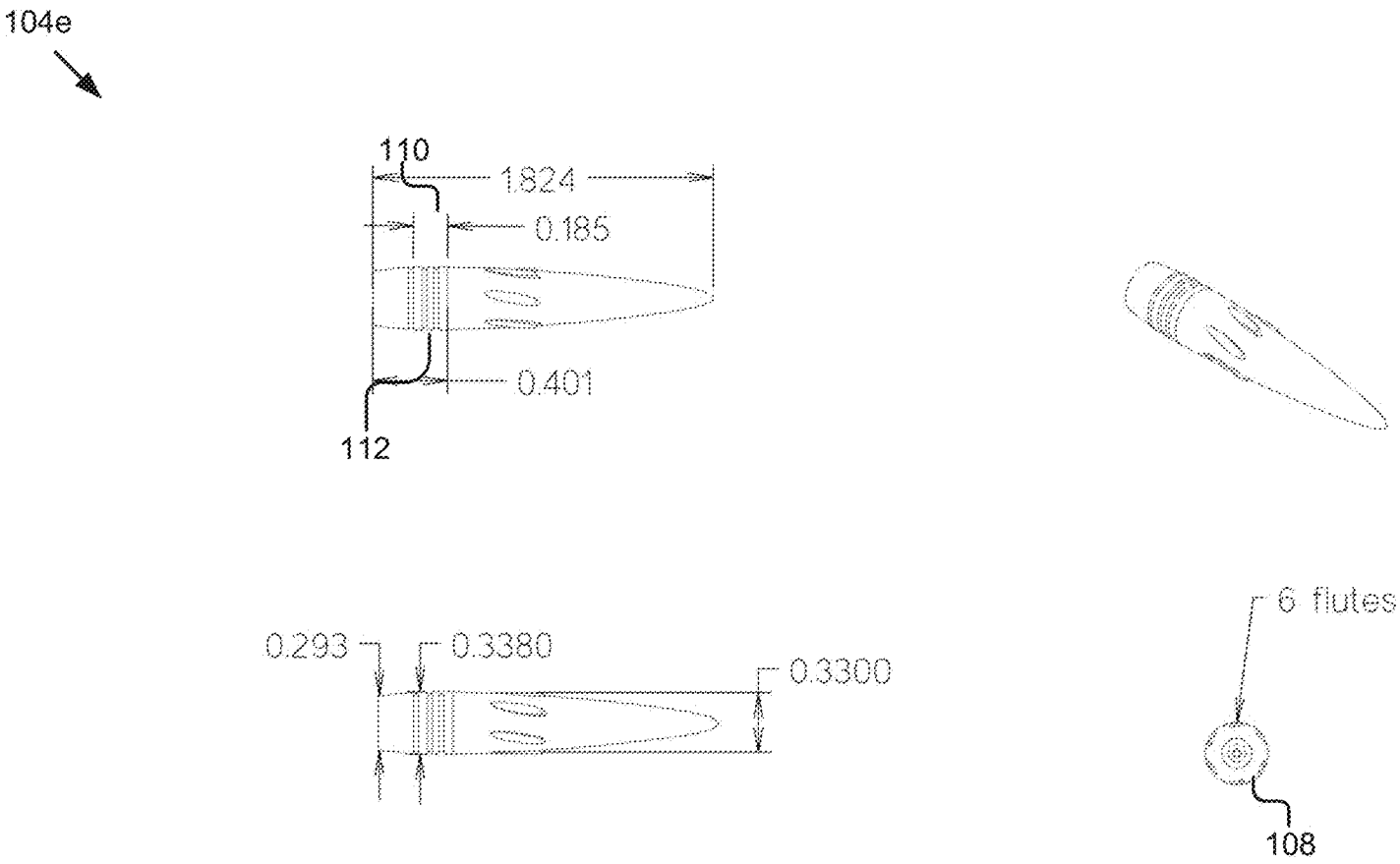
FIG. 9 is another example projectile.

FIG. 9 is an example projectile 104*e*. As shown, this specific example projectile includes a segmented driving band 110 dimension as shown with multiple grooves 112. As described elsewhere herein, one or more of these grooves 112 could receive latex rings or other types of material that fit within the groove 112 that can assist in providing a seal with the bore and/or impart a rotation on the projectile 104*e* as it moves down the bore. As described elsewhere herein, one or more of the grooves 112 could include material to lubricate the bore of the barrel as the projectile 104 passes through the bore. As shown in this example, six flutes 108 are shown on the projectile 104*d*. This example is configured to be used in a specific caliber with a barrel that has six rifling. As shown, the driving band 110 dimension is the widest portion of the projectile 104*e* and configured to make frictional contact with the interior of the bare of the barrel when fired. It should be understood that these dimensions are shown merely by way of example for a specific caliber of projectile and other dimensions that are appropriate for other calibers are also contemplated.

In some implementations, the freebore (the space between the neck and lead of a barrel) has also been optimized in the projectile system 100 to effectively deal with ogive/bore interface and maximize accuracy. The freebore length affects when the projectile engages with the rifling of the barrel after it is fired. With respect to the projectile system 100 implementations, this freebore value has been optimized to be less than 0.632 caliber (and specifically 0.2147 for a 338 projectile) with estimated optimal being 0.0" to 0.050". 1" In this example, by choking back on the freebore, the design ensures that the bearing surface has no chance to deflect or vector once the round is fired. Rather, it immediately enters the bore, which ensures that the round is stabilized as much as feasibly possible.

Figure 10:
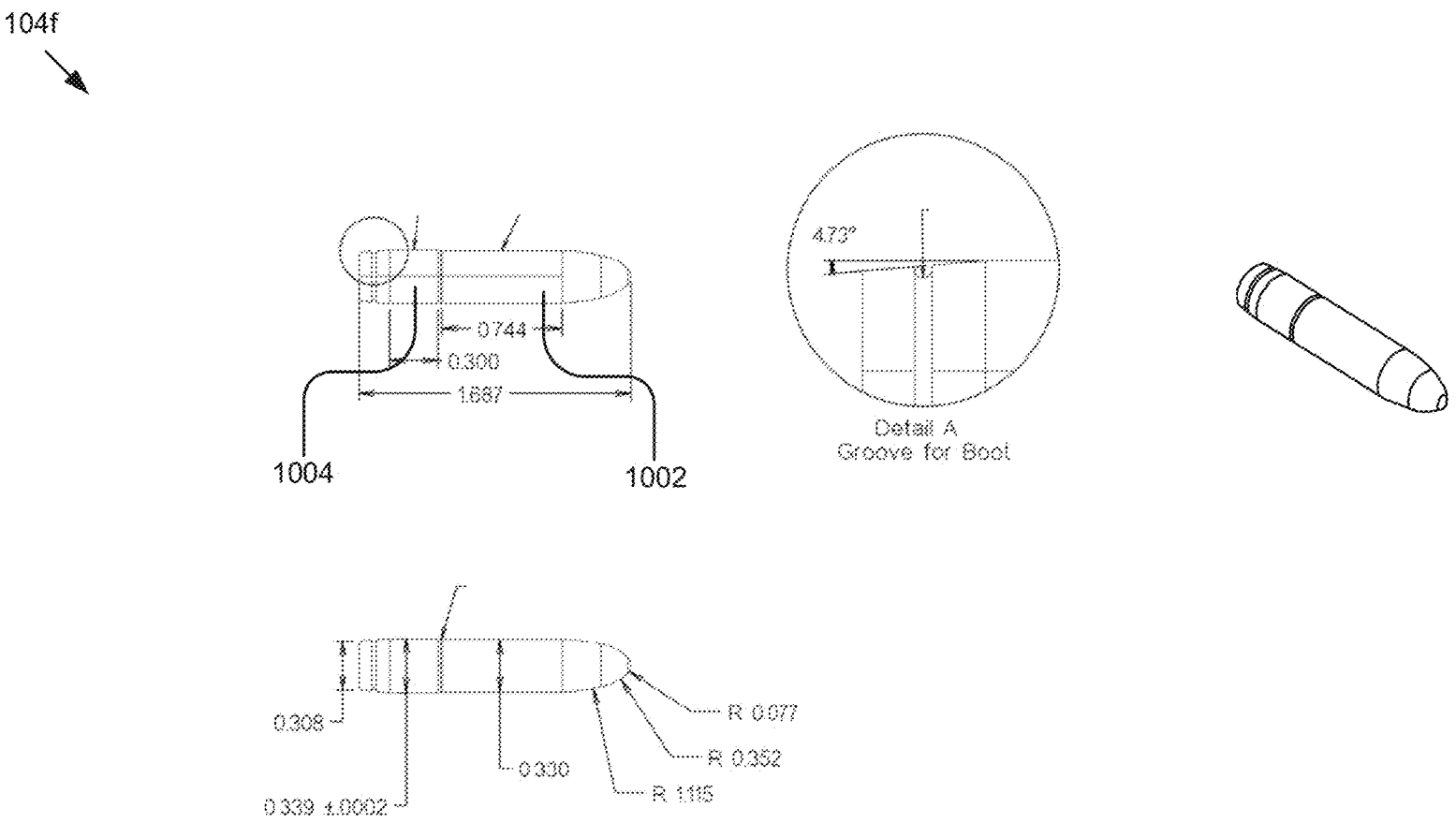
FIG. 10 is another example projectile.

FIG. 10 shows another example projectile 104*f*. In another example embodiment, the projectile 104*f* could be developed with a stabilizing front section 1002, which could also be achieved with the bore gauge lugs (e.g. grooves/flutes 108) which would allow for reduced bearing sections 1004 and therefore reduced friction in the barrel and a higher muzzle velocity and muzzle energy of the projectile 104*f*. Another way of stabilizing the projectile 104 would be to abandon the lugs and secant Ogive design and simply build a bore gauge projectile with a trailing end that was rifling gauge or caliber. For example, in a 338 rifle the bulk of the projectile 104*f* would be 0.330" diameter and the trailing or bearing surface 1004 would be 0.338". The aerodynamic characteristics would not be as efficient as the decant Ogive design described elsewhere herein, but a high muzzle velocity would be achievable due to reduced friction of the smaller bearing area 1004.

The formula for bullet RPM is: Muzzle Velocity (fps)× 720/Twist rate. The maximum bullet RPM is in the neighborhood of 300000. Bullet failures may occur at higher spin values and this is due to friction and heat. Given that the projectile 104 as described herein has a lower friction level and therefore generates less heat it plausible to assume to a person skilled in the art, that these designs allow for higher spin. Furthermore, the faster the bullet spins the more stable it is, which allows for the projectile 104 to have both the faster bullet spin and be more stable, improving accuracy and muzzle velocity of the projectile 104.

In one example, a 338 projectile round runs 3200 fps in a 9.3 twist barrel which results in 247,742 rpm. The calculated optimum twist rate is somewhere between 6.76 and 8.45. The optimum twist rate can be calculated based on length (in this specific example, 1.819) to diameter (338) which is 5.38 and that the required twist rate could be 20-25 calibers which yields the above numbers. Which yields RPMs of 341000 and 272000. In an example that can achieve the desired muzzle velocity, the projected RPM would be well above 300000, which is higher than conventional 338 projectiles currently can attain.

It should be understood that the above-described example embodiments are provided by way of illustration and not limitation and that numerous additional use cases are contemplated and encompassed by the present disclosure. In the above description, for purposes of explanation, numerous specific details are set forth in order to provide a thorough understanding of the present disclosure. However, it should be understood that the hardware and technology described herein may be practiced without these specific details. Various implementations are described as having particular hardware, software, and technology. However, the present disclosure applies to any type of device that can receive data and commands, and to any peripheral devices providing services.

The foregoing description has been presented for the purposes of illustration and description. It is not intended to be exhaustive or to limit the specification to the precise form disclosed. Many modifications and variations are possible in light of the above teaching. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies and other aspects are not mandatory or significant, and the mechanisms that implement the specification or its features may have different names, divisions and/or formats.

Furthermore, the modules, routines, features, attributes, methodologies and other aspects of the disclosure can be implemented as software, hardware, firmware, or any combination of the foregoing. Also, wherever an element, an example of which is a module, of the specification is implemented as software, the element can be implemented as a standalone program, as part of a larger program, as a plurality of separate programs, as a statically or dynamically linked library, as a kernel loadable module, as a device driver, and/or in every and any other way known now or in the future. Additionally, the disclosure is in no way limited to implementation in any specific programming language, or for any specific operating system or environment. Accordingly, the disclosure is intended to be illustrative, but not limiting, of the scope of the subject matter set forth in the following claims.

What is claimed is:

1. A projectile system comprising:

a projectile body, the projectile body including a front end portion that tapers to a point at a front end and the front end portion of the projectile body is dimensionally smaller than a bore of a firearm system, the projectile body including a driving band portion behind the front end portion of the projectile body, the driving band portion being dimensionally equal to a caliber of the firearm system and dimensionally greater than a bore diameter of the firearm system, such that the driving band portion comes into contact with the bore of the firearm system when a projectile passes through the bore of the firearm system, the projectile body including an end portion behind the driving band portion; and a boot configured to wrap around the end portion of the projectile body and provide an additional seal when the projectile passes through the bore of the firearm system.

2. The projectile system of claim 1, wherein the front end portion of the projectile body further includes a plurality of flutes configured to center the projectile body within the bore of the firearm system when the projectile body is positioned into the firearm system.

3. The projectile system of claim 2, wherein the plurality of flutes includes at least four flutes.

4. The projectile system of claim 2, wherein the plurality of flutes includes at least five flutes.

5. The projectile system of claim 2, wherein the plurality of flutes includes six flutes.

6. The projectile system of claim 1, wherein the projectile body includes one or more grooves formed into an exterior surface of the projectile body.

7. The projectile system of claim 6, wherein one or more grooves are configured to retain one or more latex bands, wherein each latex band of the one or more latex bands wrap around the projectile body and are seated within different grooves of the one or more grooves.

8. The projectile system of claim 6, wherein the one or more grooves include a lubricant, such that when the projectile is moving down the bore, the lubricant coats the bore.

9. The projectile system of claim 8, wherein the one or more grooves are positioned on the projectile body ahead of the driving band portion and the lubricant coats the bore ahead of the driving band portion as the projectile is moving down the bore.

10. The projectile system of claim 1, wherein the driving band portion is segmented and one or more grooves are within the driving band portion of the projectile band.

11. The projectile system of claim 1, wherein the boot is configured to disengage from the projectile body as the projectile moves down and exits the bore.

12. The projectile system of claim 11, wherein the boot cleans a surface of the bore as the projectile moves down and exits the bore.

13. The projectile system of claim 1, wherein the projectile body further includes a plurality of flutes configured to center the projectile body within the bore of the firearm system and wherein a quantity of flutes in the plurality of flutes matches with a rifling pattern within the bore of the firearm system.

14. The projectile system of claim 13, wherein the plurality of flutes are in vectored positions to impart a rotation that matches the rotation generated by rifling pattern within the bore of the firearm system.

15. The projectile system of claim 14, wherein the plurality of flutes impart aerodynamic spin to the projectile body when the projectile body is fired from the bore.

16. The projectile system of claim 1, wherein driving band portion of the projectile body is dimensionally wider than the other portions of the projectile body and the driving band portion is configured to make frictional contact with an interior of the bore when fired.

17. The projectile system of claim 16, wherein the driving band portion has a reduced bearing surface when only the driving band portion engages with the bore.

18. The projectile system of claim 17, wherein the driving band portion is able to maintain a high engraving efficiency.

* * * * *